United States Patent [19]

Fisher

[11] Patent Number: 4,624,200

[45] Date of Patent: Nov. 25, 1986

[54] APPARATUS AND METHOD FOR FORMING A DOUBLE-FOLDED WIDE HEM IN CUT TEXTILE ARTICLES

[75] Inventor: William S. Fisher, Concord, N.C.

[73] Assignee: Cannon Mills Company, Kannapolis, N.C.

[21] Appl. No.: 745,326

[22] Filed: Jun. 14, 1985

[51] Int. Cl.[4] ..... D05B 21/00; D05B 35/02

[52] U.S. Cl. ..... 112/121.12; 112/141; 112/147; 112/DIG. 2

[58] Field of Search ..... 112/121.12, 121.15, 112/141, 142, 147, DIG. 2, DIG. 3

[56] References Cited

U.S. PATENT DOCUMENTS

| | | | |
|---|---|---|---|
| 3,224,394 | 12/1965 | Dobner et al. | 112/121.15 X |
| 3,534,954 | 10/1970 | Lynch, Jr. | 112/121.15 X |
| 3,544,098 | 12/1970 | Hawley et al. | 112/DIG. 2 X |
| 3,773,002 | 11/1973 | Burton | 112/121.12 |
| 3,906,878 | 9/1975 | Burton | 112/423 |
| 4,214,541 | 7/1980 | Zeigler, Jr. et al. | 112/262.3 |
| 4,271,774 | 6/1981 | Burton | 112/141 X |
| 4,353,316 | 10/1982 | Brocklehurst | 112/141 X |
| 4,462,322 | 7/1984 | Brocklehurst | 112/141 |
| 4,464,160 | 8/1984 | Joyce | 112/141 X |
| 4,491,079 | 1/1985 | Gustavsson | 112/121.15 |
| 4,562,782 | 1/1986 | Doucette et al. | 112/121.15 X |

FOREIGN PATENT DOCUMENTS

| | | | |
|---|---|---|---|
| 59-46194 | 11/1984 | Japan | 112/141 |
| 59-46623 | 11/1984 | Japan | 112/147 |

*Primary Examiner*—Wm. Carter Reynolds

*Attorney, Agent, or Firm*—Bell, Seltzer, Park & Gibson

[57] ABSTRACT

An apparatus and method is provided for forming a double-folded wide hem in cut textile articles, such as would be used for the open entrance end of a pillowcase, the top of a bed sheet and the like. Rectangular cut articles are successively fed in a longitudinal path of travel and are stopped for hem folding during such travel. A predetermined width of one edge portion extending in the longitudinal direction of the path of travel of each article is elevated and stopped in the folding position. The elevated portion is folded over the remainder of the article and over a stationary folding shoe having a transverse dimension corresponding to the desired width of the wide hem being formed in the article, while forming a first fold in the edge portion of the article around an outer longitudinally-extending edge of the stationary folding shoe. A forwardly-extending portion of the folded-over edge portion of the article is folded around and under an inward longitudinally-extending edge portion of the stationary folding shoe, while forming a second fold in the article to complete folding of the double-folded hem. The articles may then be fed from the folding mechanisms and through a sewing machine for stitching the double-folded wide hem in the textile article.

7 Claims, 15 Drawing Figures

AIR SOURCE 10
12
18
19
20
21
23
24
25
26
28
29
35
37
40
44
45
50
51
52
53
55
60
65
70
75
76
77
78
79
80
A
H
6

APPARATUS AND METHOD FOR FORMING A DOUBLE-FOLDED WIDE HEM IN CUT TEXTILE ARTICLES

FIELD OF THE INVENTION

This invention relates to an apparatus and method for forming a double-folded wide hem in cut textile articles, such as would be used for the open entrance end of a pillowcase, the top of a bed sheet, and the like.

BACKGROUND OF THE INVENTION

Heretofore, the double-folded wide hems for pillowcases, bed sheets and the like could not be formed on the typical curved, generally C-shaped, folding shoes utilized for forming conventional narrow folded hems for textile articles because of the width of such hems. While various mechanisms have been proposed for forming these double-folded wide hems, such as disclosed in U.S. Pat. Nos. 4,353,316 and 4,462,322, these mechanisms have generally been unsatisfactory from the standpoint of forming consistent dimensions in such wide hems or requiring excessive labor. Specifically, the wide hem forming mechanism suggested in the above listed U.S. patents provides for the use of air to expand a conventional narrow folded hem to a wide hem which does not necessarily provide consistent diemsnions in such wide hem.

OBJECTS AND SUMMARY OF THE INVENTION

Accordingly, it is the object of this invention to provide a method and apparatus which will satisfactorily form a doublefolded wide hem in cut textile articles and which improves previously proposed mechanisms.

By this invention, it has been found that this object may be accomplished by providing method and apparatus for forming a double-folded wide hem in cut textile articles which include generally the following.

The cut textile articles are successively fed in a generally longitudinal path of travel through an apparatus and are stopped during such travel for hem folding. A predetermined width of one edge portion extending in the longitudinal direction of the path of travel of each article is elevated above the remainder of the article.

The elevated portion of each article is then folded, while in the stopped position, over the remainder of the article and over a stationary folding shoe having a transverse dimension corresponding to the desired width of the wide hem being formed in the article, while forming a first fold in the edge portion of the article around an outer longitudinally-extending edge of the stationary folding shoe. This folding operation is preferably performed by a reciprocating platform device which receives the elevated edge portion of the article from a ramp and reciprocates inwardly over the stationary folding shoe to carry the edge portion of the article being folded over the folding shoe.

A forwardly extending section of the folded-over edge portion of the article is then folded around and under an inward longitudinally-extending edge portion of the stationary folding shoe, while forming a second fold in the article to complete folding of the double-folded hem. This folding operation is preferably performed by a movable folding shoe which reciprocates between a first position transversely inwardly of the stationary folding shoe and slightly below the inside edge of the stationary folding shoe to a second position extending under the inside edge of the stationary folding shoe.

BRIEF DESCRIPTION OF THE DRAWINGS

While some of the objects and advantages of this invention have been set forth, other objects and advantages will appear as the description continues when taken in conjunction with the accompanying drawings, in which.

DESCRIPTION OF PREFERRED EMBODIMENT

Figures 1, 2:
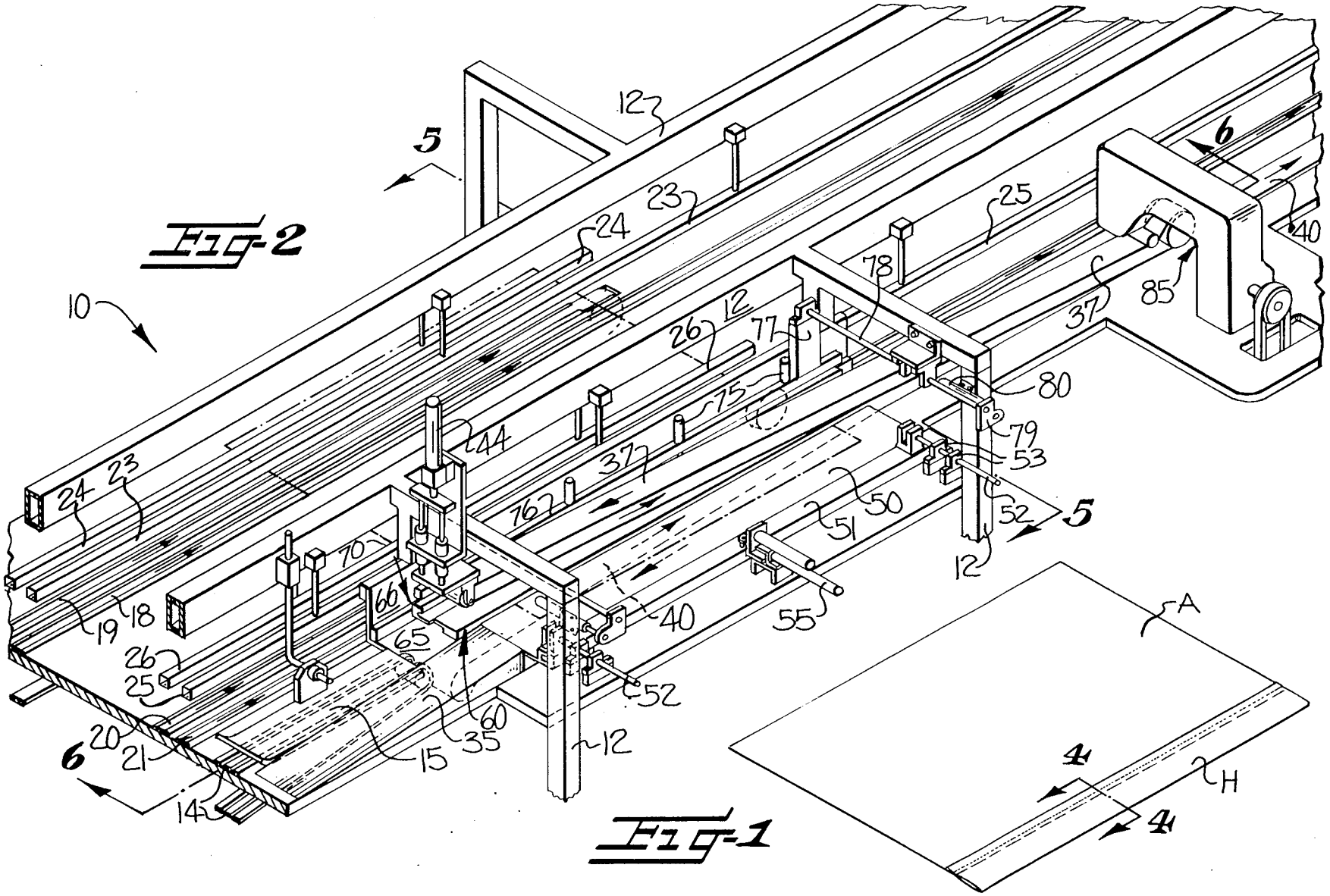
FIG. 1 is a perspective view of a cut textile article having a double-folded hem formed therein in accordance with this invention.
FIG. 2 is a perspective, somewhat schematic, view of an apparatus constructed in accordance with this invention.

Referring now to the drawings, an apparatus, generally indicated at 10 (FIG. 2), forms a double-folded wide hem H in a cut textile article A (FIG. 1), such as would be used for the open entrance end of a pillowcase. This wide hem H is usually approximately 4 inches in width, which is much wider than a normal hem formed on cut textile articles.

Figure 3:
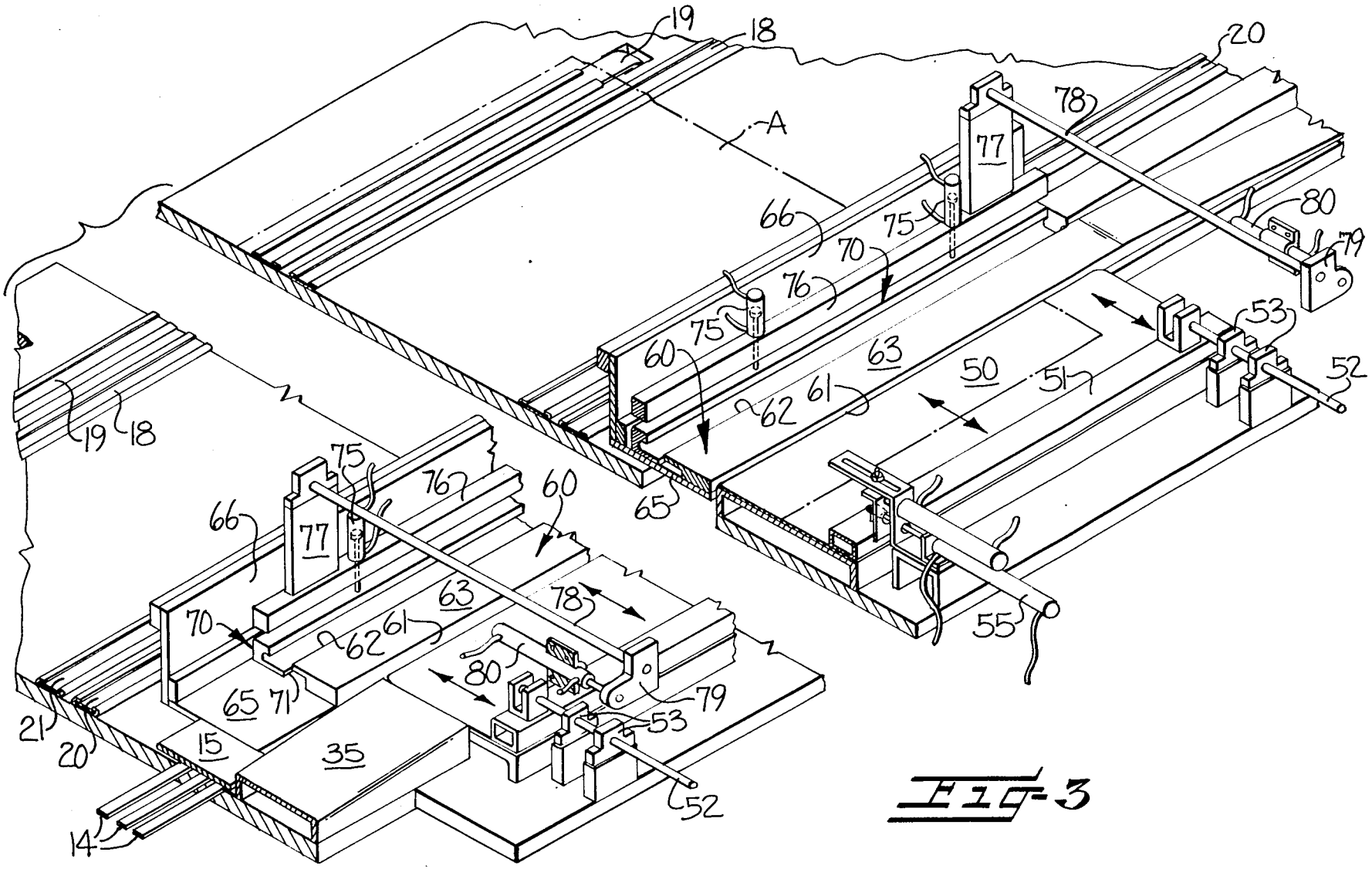
FIG. 3 is an enlarged perspective view, broken away, of the apparatus illustrated in FIG. 1 with parts thereof removed for clarity.

The apparatus 10 (as shown in FIG. 2), may be a self-contained apparatus which receives cut textile articles A successively from an input station (not shown), forms the wide hem H in the article A and takes up or accumulates the hemmed textile articles A at an output station (not shown). Also, the apparatus 10 (as shown in FIG. 2), may form an intermediate station of an overall product fabricating machine, such as a pillowcase fabricating machine wherein the apparatus 10 receives cut textile articles A from a cutting station after successive cutting of the articles A from a continuous supply of the material and which supplies the hemmed articles A to further fabricating stations for completing fabrication of the pillowcase. FIG. 3 of the drawings illustrates the apparatus 10 of FIG. 2 enlarged, partially broken away and with certain parts removed for clarity of illustration of the illustrated parts. The remaining figures of the drawings are sectional views taken along the various lines in the brief description of the drawings set forth above and clearly shown on the various figures of the drawings.

The apparatus 10 includes a frame consisting of individual and/or interconnected components, all of which are collectively indicated by the reference numeral 12.

All of the frame components are not illustrated in the drawings and it is to be understood that an overall frame is provided for carrying the various mechanisms of the apparatus 10 to be described below.

Feeding means are carried by the frame 12 for successively feeding the generally rectangular cut articles A longitudinally through the apparatus 10 in a generally horizontal path of travel and for stopping the articles A in a hem folding position during their travel through the apparatus 10. These feeding means are constituted by various feeding mechanisms which will be described in more detail below as the flow of the cut articles A through the apparatus 10 is described.

The cut articles A are successively fed into the apparatus 10 from a supply station or from other stations of an overall fabricating machine (neither of which is illustrated in the drawings) and are successively fed in a longitudinal direction through the apparatus 10 (FIG. 2) and in a generally horizontal path of travel by a set of driven conveyor belts 14 positioned under a plate 15 and both of which terminate just prior to the folding mechanisms, to be described below. These conveyor belts 14 and plate 15 are positioned in the apparatus 10 near the outside edge portion of the cut article A to be folded.

Figures 4, 5:
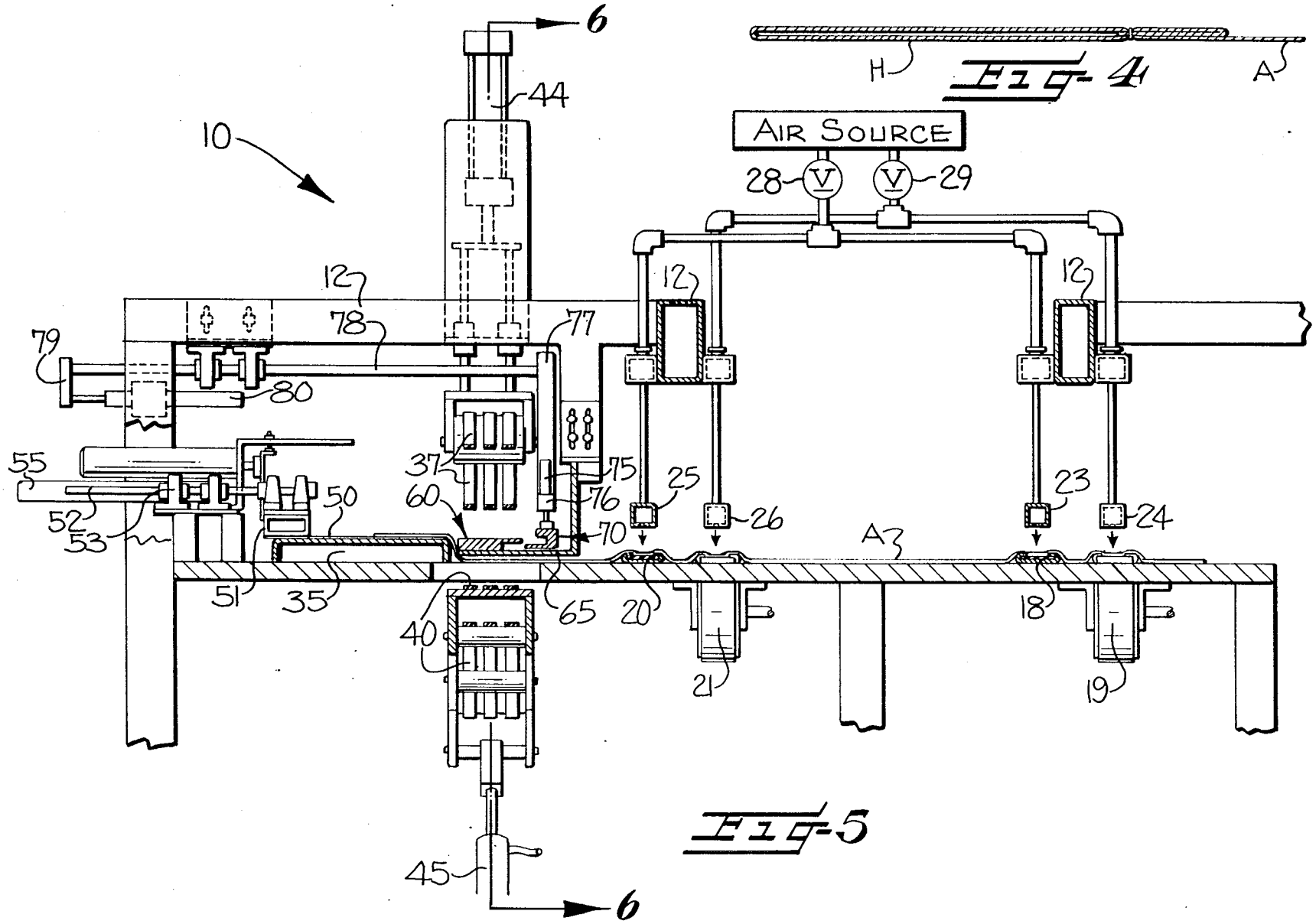
FIG. 4 is a cross sectional view, taken generally along the line 4—4 of FIG. 1, through the double-folded hem formed in the textile article.
FIG. 5 is a transverse sectional view, taken generally along the line 5—5 of FIG. 2.
Figure 6:
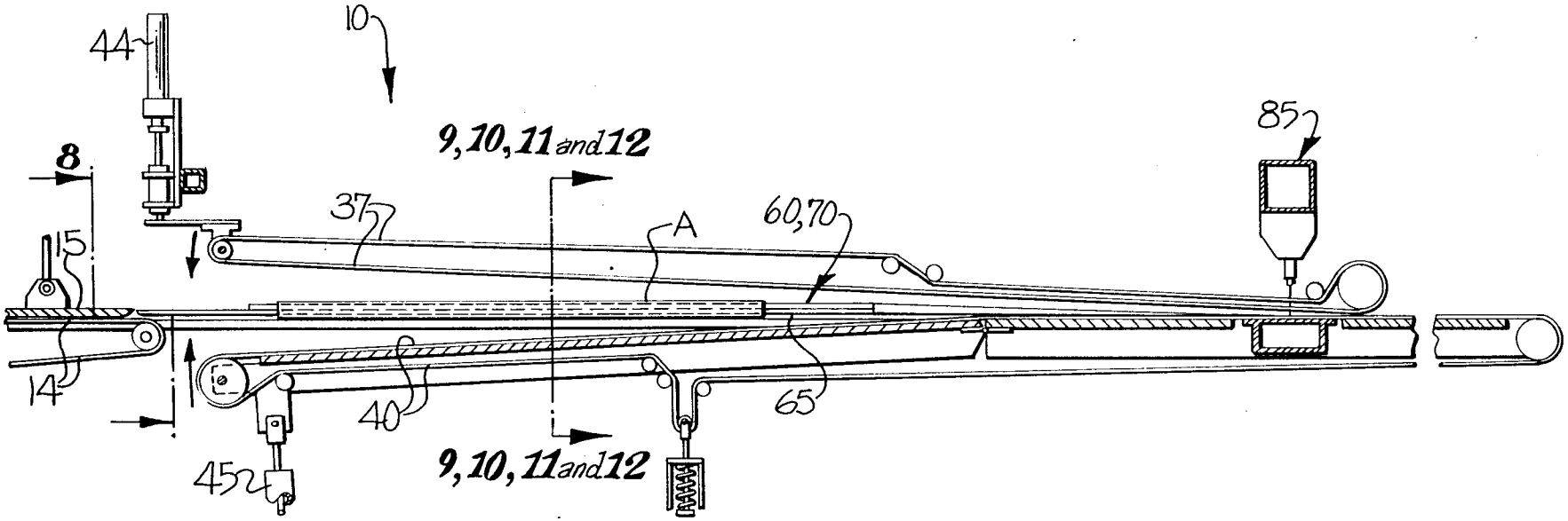
FIG. 6 is a longitudinal sectional view, taken generally along the line 6—6 of FIGS. 2 and 5, and with the feeding mechanisms shown in their non-feeding position.

The feeding means further include sets of conveyor belts 18, 19 and 20, 21 extending longitudinally of the apparatus and positioned for successively receiving on the top thereof the portion of each of the articles A which is not to be folded. The conveyor belts 19, 21 extend only through the folding mechanisms, to be described below, of the apparatus 10 and the conveyor belts 18, 20 extend substantially the full length of the apparatus 10. Means cooperate with these sets of conveyor belts 18, 19, and 20, 21 for holding each of the articles A against the conveyor belts during travel of the articles A through the apparatus 10 and for successively releasing such engagement when each of the articles A reaches the folding mechanisms, to be described below, for allowing such article A to stop in a folding position. These mechanisms for holding the articles A against the sets of conveyor belts comprise air manifolds 23, 24 and 25, 26 suspended from frame members 12. The air manifolds 23, 24 and 25, 26 receive air from a suitable source (FIG. 5) upon actuation of solenoid operated valves 28, 29 to apply streams of air against the top surface of articles A to hold the articles A in engagement with the sets of conveyor belts 18, 19 and 20, 21 when feed of the articles A through the apparatus 10 is desired. The air is shut off to the air manifolds 23, 24 and 25, 26 by valves 28, 29 when an article A reaches the folding position to stop the articles A for hem folding of the article A in the folding position.

As the articles A are succesively fed toward the stopped folding position adjacent the folding mechanisms, to be described below, a predetermined width of one edge portion of the article A to be folded is fed by the above described feeding mechanisms up a ramp device 35 carried by the frame 12 for elevating such predetermined width of the one edge portion of the article A to be folded as each article A is fed by the above described feeding means to the stopped folding position. The aforementioned conveyor belts 14 and plate 15 assist in feeding this edge portion of each article A up the ramp mechanism 35.

Figure 7:
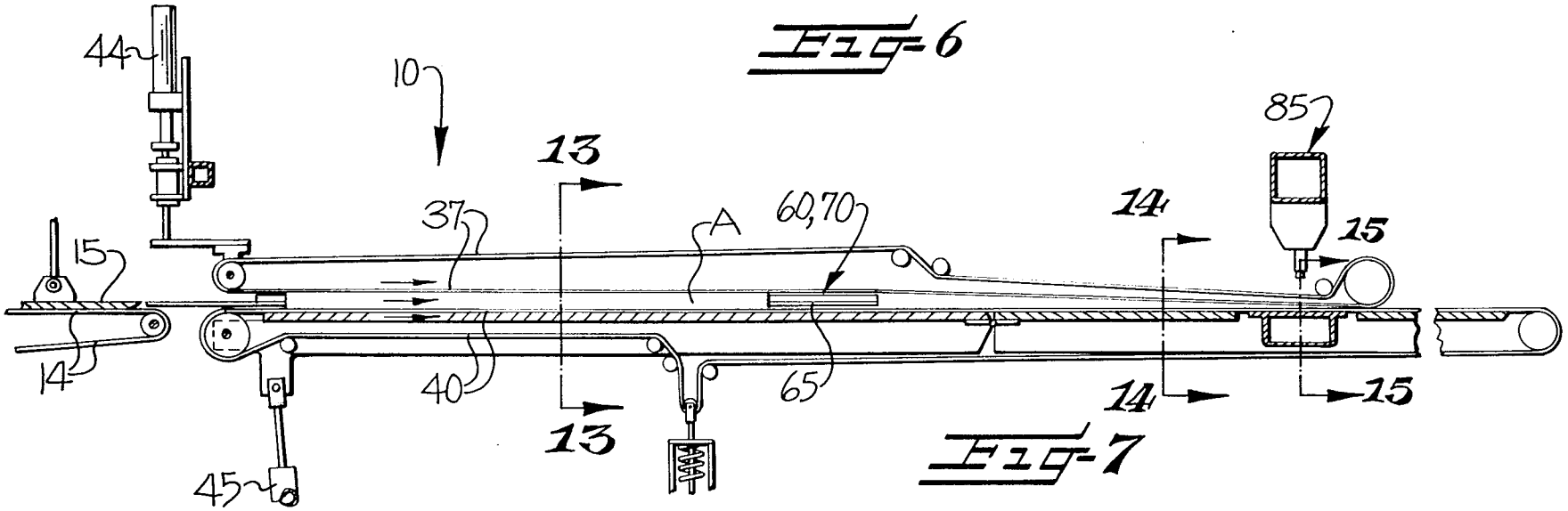
FIG. 7 is a sectional view, like FIG. 6, with the feeding mechanisms shown in their feeding position.
Figure 8:
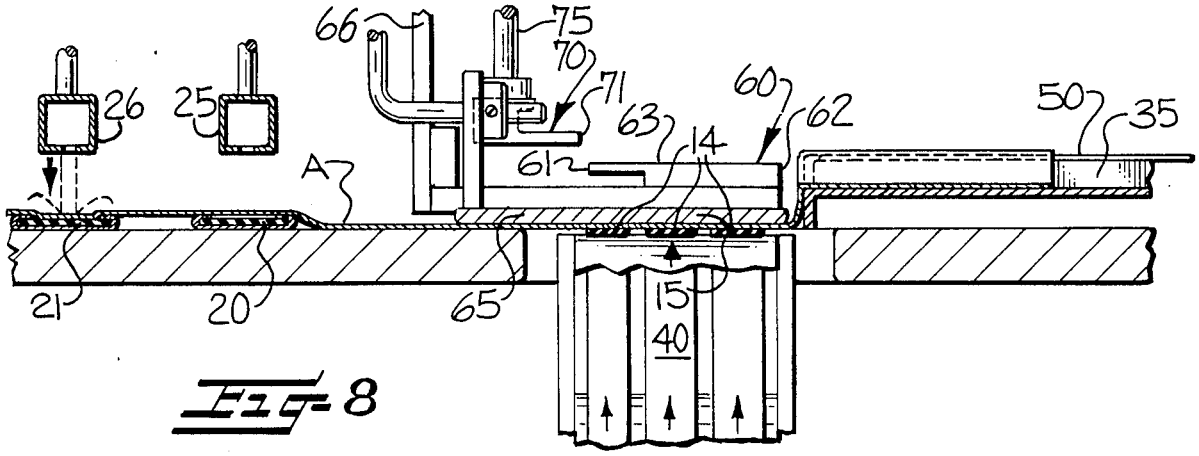
FIGS. 8–15 are sectional views, taken generally along the lines 8—8 throug 15—15 of FIGS. 6 and 7 showing the operation of the folding devices in the various sequences utilized in forming the double-folded hem.
Figure 9:
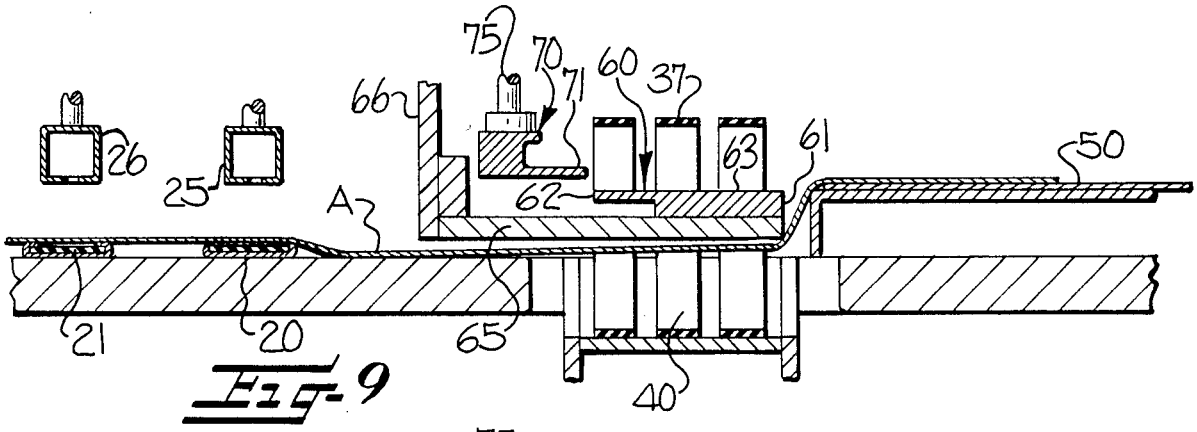
Figure 12:
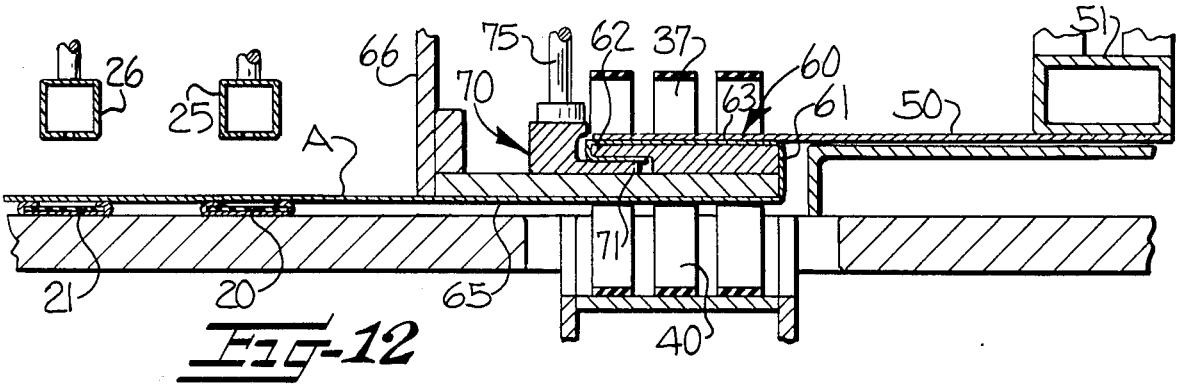
Figure 13:
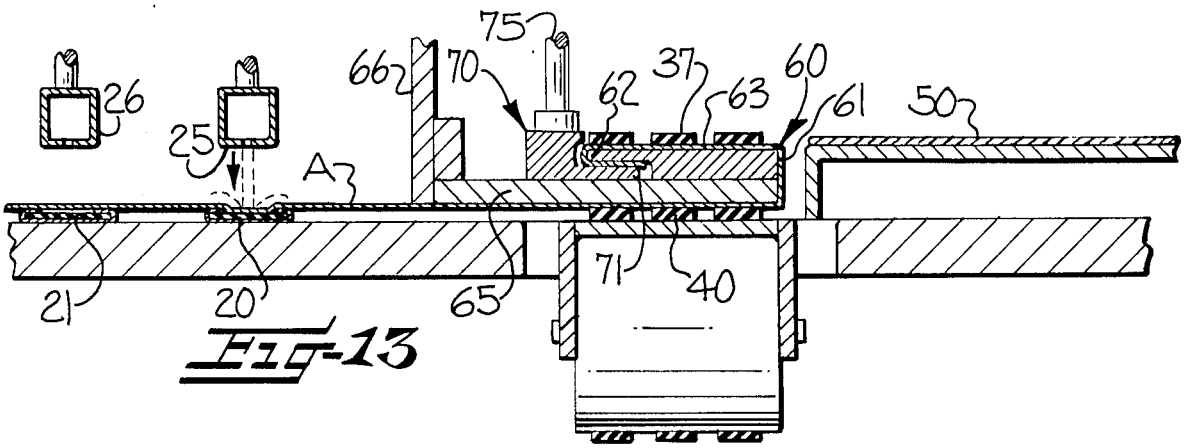

Additional feeding mechanisms in the form of a set of at least one driven conveyor belt 37 extending longitudinally of the apparatus 10 is pivotally mounted downstream of the stopped folding position of the articles A for movement between a first position above and out of engagement with the articles A in the folding position (FIGS. 2, 6 and 9–12), to allow folding thereof while an article A is stopped and a second position in engagement with the top of the article A for feeding of the article A out of the stopped folding position (FIGS. 7 and 13).

Similarly, a further set of a least one driven conveyor belt 40 extends longitudinally of the apparatus below at least the folding mechanisms, to be described below, and is pivotally mounted downstream of the stopped folding position of the articles A for movement between a first position below and out of engagement with the articles A in the folding position (FIGS. 2, 6 and 9–12), to allow folding of the article A while in the stopped position and a second position in engagement with the bottom of the articles A (FIGS. 7 and 13), for feeding the articles A out of the folding position and through the remainder of the apparatus 10.

These sets of conveyor belts 37, 40 are pivotally moved by suitable piston and cylinder mechanisms 44, 45, respectively, which are carried by the frame 12 between their first and second nonfeeding and feeding positions. Other pulleys, guide rods, tension mechanisms, etc. are associated with these conveyor belt devices 37, 40, but need not be specifically described herein.

The apparatus 10 further includes means carried by the frame 12 for folding a double-folded wide hem along the one edge of the cut textile article A extending longitudinally of the apparatus when the article A is stopped by the above described feeding mechanisms in the folded position. The folding mechanisms include, in the addition to the above described ramp mechanism 35, the following devices.

A platform or folding blade device 50 extends generally horizontally at least the length of the longitudinal edge of the cut article A to be folded and is carried by the frame 12 through a bar 51 attached thereto and carried by rod and bracket guides 52, 53 secured thereto and to a portion of the frame 12. The platform device 50 further includes means for horizontally reciprocating the platform device 50 transversely of the apparatus 10 between a first position (FIGS. 2 and 9) for receiving on the top thereof the elevated edge portion of the article A in its stopped folding position from the ramp device 35 and a second position (FIG. 10) transversely inwardly of the apparatus 10 for carrying the edge portion to be folded of the article A over the remainder of the article A (FIG. 10. The platform device 50 then reciprocates back to its first position (FIGS. 10–13) for performing the remainder of the folding operation, to be described below, on the edge portion of the article A and for feeding the ultimately double-folded article A away from the folding means (FIG. 13). For performing the above described reciprocating of the platform device between its first and second positions, there is provided a piston and cylinder mechanism 55 attached to the bar 51 and to the frame portion 12.

Figure 10:
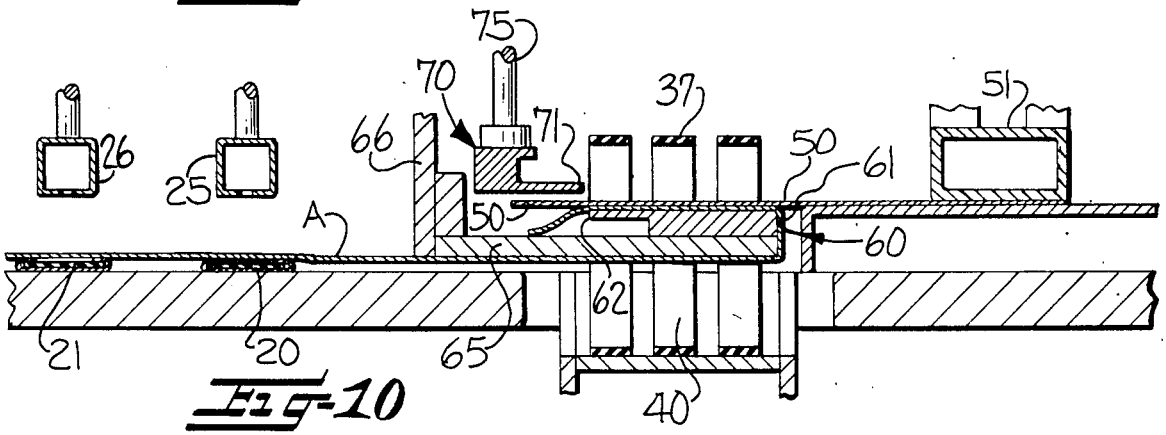
Figure 11:
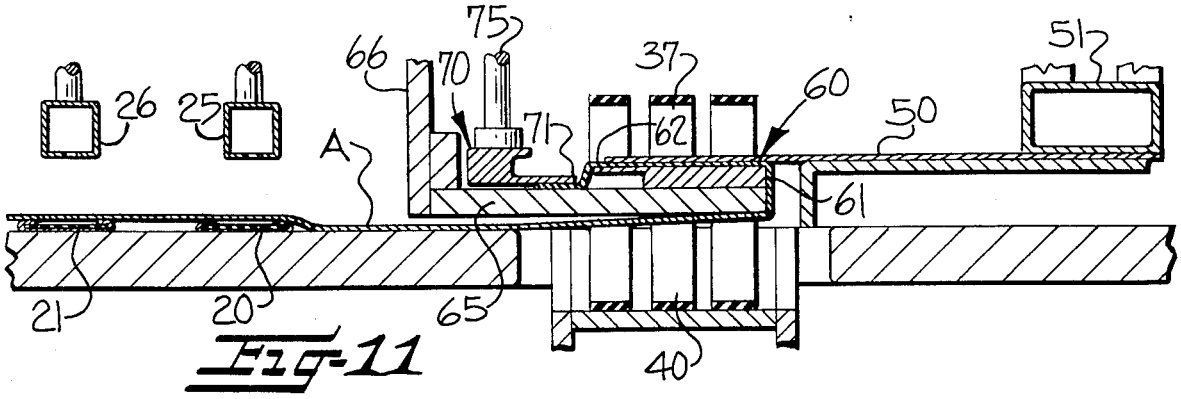

A stationary folding shoe device 60 is supported by the apparatus frame 12 and has an outside edge 61 and an inside edge 62 extending longitudinally of the apparatus 10 and a generally rectangular horizontal upper surface 63 of a predetermined dimension between the edges 61, 62 corresponding to the desired transverse dimension of the double-folded hem H being formed in the article A. This stationary folding shoe 60 is positioned transversely inwardly in the apparatus 10 from the platform 50 in its first position (FIG. 9) and slightly below the platform 50 and above the remainder of the article A being folded for cooperating with the platform 50 to form a first fold in the article A about the outside edge 61 and to receive the edge portion being folded of the article A on the upper surface 63 to extend over the inside edge 62 as the platform 50 moves to its second position extending over the stationary folding shoe 60 (FIG. 10). The stationary folding shoe 60 is carried in the above described position by a generally horizontal plate 65 and a generally vertical plate 66 carried by the apparatus frame 12. The plate 65 is positioned above a flat upper surface of the frame 12 which receives the remainder of the article A when the article A is placed in the stopped folding position. The stationary folding shoe 60 further includes a cut-out in the underside thereof extending from the inside edge 62 for cooperation with further folding mechanisms, to be described below.

A movable folding shoe device 70 is carried by the apparatus frame 12 for horizontal reciprocating movement transversely of the apparatus 10 between a first position transversely inwardly in the apparatus 10 from the stationary folding shoe 60 and slightly below the inside edge 62 of the stationary folding shoe 60 (FIG. 11) and a second position in which a forward edge 71 extends under the inside edge 62 of the stationary folding shoe 60 for cooperating therewith to fold the extending edge portion of the article A about and under the inside edge 62 of the stationary folding shoe 60 to form a second fold in the article A (FIG. 12).

The movable folding shoe 70 is further mounted for vertical reciprocating movement, while in its above described first transverse inward position, between an upper position above the platform 50 (FIGS. 9 and 10) to allow the platform 50 to move between its first and second positions without interruption, and a lower position slightly below the inside edge 62 of the folding shoe 60 to engage the top of the folded-over portion of the edge of the article A which extends over the inside edge 62 of the stationary folding shoe 60 (FIG. 11) to allow horizontal movement of the movable folding shoe 70 to its second transverse position (FIG. 12) under the inside edge 62 of the stationary folding shoe 60 to form the second fold in the article A.

The means for effecting the above described up and down vertical reciprocating movement and the transverse inward and outward horizontal reciprocating movement of the movable folding shoe 70 include (FIGS. 2 and 3) fluid-operated piston and cylinders 75 in which the piston is secured to the movable folding shoe 70 and the cylinder is secured to a longitudinally-extending rail 76 carried by vertically-extending plates 77 which are in turn carried by horizontally-extending rods 78 attached to generally vertically-extending plates 79. The plates 79 are secured to one end of fluid-operated piston and cylinder mechanisms 80 which are in turn carried by suitable plates and brackets from a stationary apparatus frame component 12. Thus, the fluid-operated piston and cylinder 75 can be operated to effect the up and down vertical reciprocating movement of the movable folding shoe 70 while the piston and cylinder mechanisms 80 can be actuated to effect the transverse horizontal reciprocating movement of the movable folding shoe 79.

As may be seen from the Figures of the drawings and the above described apparatus, generally rectangular cut articles A are successively fed in a longitudinal path of travel into the apparatus 10 by the sets of conveyor belts 18, 19 and 20, 21 through engagement therewith provided by the air manifolds 23, 24 and 25, 26. The edge portion of each article A to be folded is fed up a ramp 35 and onto the top of platform 50 by conveyor belts 14 and cooperating plate 15.

As soon as the edge portion of the article A to be folded is positioned entirely on top of the platform 50 in its elevated position and adjacent the stationary folding shoe device 60 and movable shoe device 70, the feed of the article A is stopped by shutting off the air to air manifolds 23, 24 and 25, 26 through valves 28, 29 to release the engagement of the articles A with the conveyor belts 18, 19 and 20, 21. this operation for stopping the feed of the articles A when the next successive article to be folded is positioned in the folding position adjacent the folding mechanisms may be accomplished by any suitable article sensing means cooperating with control mechanisms (not shown) for operating the solenoid-operated valves 28, 29 to shut off the supply of air to the air manifolds 23, 24 and 25, 26.

The elevated edge portion of the article A in the stopped folded position is then folded over the remainder of the article A and over the stationary folding shoe 60, which has a transverse dimension corresponding to the desired width of the wide hem H being formed in the article A, while forming the first fold in the edge portion of the article A around an outer longitudinally-extending edge 61 of the stationary folding shoe 60 by horizontal reciprocation of the platform 50 from its first outward position to its second inward position. This reciprocating movement of the platform 50 releases the elevated portion of the article A to be folded from the top surface of the platform 50 and positions such edge portion to be folded of the article A on the top surface 63 of the stationary folding shoe 60 to extend over the inward edge 62 thereof. The platform 50 then reciprocates back to its first outward position for receipt of the next successive article A.

Thereafter, the movable folding shoe 70 vertically reciprocates from its upper position to its lower position for engaging the edge portion of the article A which extends over the inward edge 62 of the stationary folding shoe. The movable folding shoe 71 then horizontally reciprocates from its first inward position to its second outward position under the inward edge 62 of the stationary folding shoe 60 and within the cut-out therein to form the second fold in the edge portion of the article A being folded.

Figure 14:
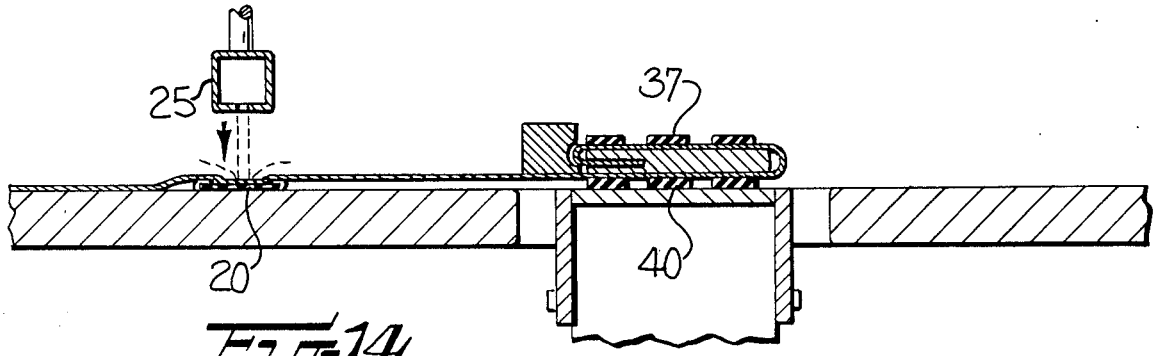
Figure 15:
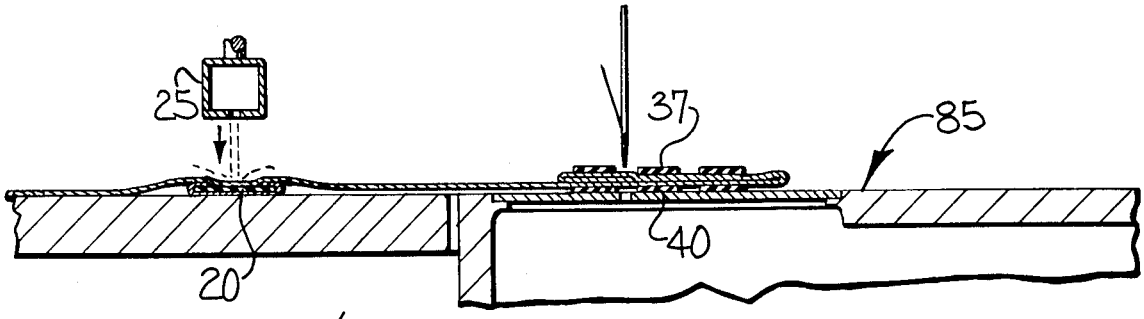

The pivotally movable sets of conveyor belts 37, 40 are then moved to their second positions in engagement with the respective top and bottoms of the double folded hem H formed around the stationary folding shoe device 60 for feeding the article A out of folding position and away from the above described folding mechanisms (FIGS. 13 and 14). This feeding is also supplemented by actuation of valve 28 to supply air to air manifold 23, 25 to cause engagement of hemmed article A with the conveyor belts 18, 20. The articles A are then fed downstream of the apparatus 10 into and through a suitable sewing machine 85 (FIGS. 2, 7 and 15) for stitching the double folded hem H in each successive article A after the above described feeding mechanisms have fed the double folded hem H of the article A away from the stationary folding shoe device 60. Each successive article A may then be fed from the sewing machine 85 to a suitable takeup or through other stations of an article fabricating machine (not shown).

The various sensing and control mechanisms for sequentially controlling operation of the above described devices have not been illustrated or described herein and such sensing and control devices are conventional and well understood by those with ordinary skill in the art and are not believed necessary for a full understanding of the present invention.

Accordingly, the present invention has provided an apparatus and method for forming a double-folded wide hem in cut textile articles, such as would be used for the open entrance end of a pillowcase, the top of a bed sheet, and the like and which overcomes problems experienced with other proposed wide hem forming apparatuses and methods.

In the drawings and specification there has been set forth a preferred embodiment of the invention, and although specific terms are employed, they are used in a generic and descriptive sense only and not for purposes of limitation, the scope of the invention being defined in the claims.

What is claimed is:

1. In an apparatus for forming a double-folded wide hem in cut textile articles, such as would be used for the open entrance end of a pillowcase, the top of a bed sheet, and the like; the improvement of means carried by said apparatus for folding a double-folded wide hem along the outside longitudinally-extending edge portion of a generally horizontally-positioned cut article, said folding means comprising movable platform means extending generally horizontally and including means for horizontally reciprocating said platform means transversely of the edge portion of the article being folded between a first position for receiving on the top thereof the edge portion of the article to be folded in an elevated position relative to the remainder fo the article and a second position transversely inwardly of the longitudinal edge portion of the article being folded for carrying such edge portion over the remainder of the article, stationary folding shoe means having inside and outside edges extending longitudinally of the edge portion of the article to be folded and a generally horizontal upper surface of a predetermined dimension between said edges corresponding to the desired transverse dimension of the double-folded hem being formed in the article and being positioned transversely inwardly of the article from said platform means in its first position and slightly below said platform means and above the remainder of the article being folded for cooperating with said platform means to form a first fold in the article about its said outside edge and to receive the edge portion being folded of the article on said top thereof to extend over said inside edge thereof as said platform moves to its second position extending over said stationary folding shoe, and movable folding shoe means including means for horizontally reciprocating said movable shoe means transversely of the edge portion of the article being folded between a first position transversely inwardly from said stationary folding shoe means and slightly below said inside edge of said stationary folding shoe means and a second position extending under said inside edge of said stationary folding shoe means for cooperating therewith to fold the extending edge portion of the article about and under said inside edge of said stationary folding shoe means to form a second fold in the article.

2. Apparatus for forming a double-folded wide hem in cut textile articles, such as would be used for the open entrance end of a pillowcase, the top of a bed sheet, and the like; said apparatus comprising:

frame means;

means carried by said frame means for successively feeding generally rectangular cut articles longitudinally through said apparatus in a generally horizontal path of travel and for stopping the articles for hem folding during their travel through said apparatus; and means carried by said frame means for folding a double-folded wide hem along one edge portion of the cut article extending longitudinally of said apparatus when the article is stopped by said feeding means; said folding means comprising ramp means extending generally longitudinally of said apparatus for receiving and elevating, relative to the remainder of the article, a predetermined width of the one edge portion of the article to be folded as each article is fed by said feeding means to the stopped folding position, platform means extending generally horizontally and including means for horizontally reciprocating said platform means transversely of said apparatus between a first position for receiving on the top thereof the elevated edge portion of the article in the stopped folding position from said ramp means and a second position transversely inwardly of said apparatus for carrying the edge portion to be folded of the article over the remainder of the article, stationary folding shoe means having inside and outside edges extending longitudinally of said apparatus and a generally horizontal upper surface of a predetermined dimension between edges corresponding to the desired transverse dimension of the double-folded hem being formed in the article and being positioned transversely inwardly in said apparatus from said platform means in its first position and slightly below said platform means and above the remainder of the article being folded for cooperating with said platform means to form a first fold in the article about its said outside edge and to receive the edge portion being folded of the article on said top thereof to extend over said inside edge thereof as said platform moves to its second position extending over said stationary folding shoe, and movable folding shoe means including means for horizontally reciprocating said movable shoe means transversely of said apparatus between a first position transversely inwardly in said apparatus from said stationary folding shoe means and slightly below said inside edge of said stationary folding shoe means and a second position extending under said inside edge of said stationary folding shoe means for cooperating therewith to fold the extending edge portion of the article about and under said inside edge of said stationary folding shoe means to form the second fold in the article.

3. Apparatus for forming a double-folded wide hem in cut textile articles, such as would be used for the open entrance end of a pillowcase, the top of a bed sheet, and the like; said apparatus comprising:

frame means;

means carried by said frame means for successively feeding generally rectangular cut articles longitudinally through said apparatus in a generally horizontal path of travel and for stopping the articles for hem folding during their travel through said apparatus;

means carried by said frame means for folding a double-folded wide hem along one edge portion of the cut article extending longitudinally of said apparatus when the article is stopped by said feeding means; said folding means comprising ramp means extending generally longitudinally of said apparatus for receiving and elevating, relative to the remainder of the article, a predetermined width of the one edge portion of the article to be folded as each article is fed by said feeding means to the stopped folding position, platform means extending generally horizontally and including means for horizontally reciprocating said platform means transversely of said apparatus between a first position for receiving on the top thereof the elevated edge portion of the article in the stopped folding position from said ramp means and a second position transversely inwardly of said apparatus for carrying the edge portion to be folded of the article over the remainder of the article, stationary folding shoe means having inside and outside edges extending longitudinally of said apparatus and a generally horizontal upper surface of a predetermined dimension between edges corresponding to the desired transverse dimension of the double-folded hem being formed in the article and being positioned transversely inwardly in said apparatus from said platform means in its first position and slightly below said platform means and above the remainder of the article being folded for cooperating with said platform means to form a first fold in the article about its said outside edge and to receive the edge portion being folded of the article on said top thereof to extend over said inside edge thereof as said platform moves to its second position extending over said stationary folding shoe, and movable folding shoe means including means for horizontally reciprocating said movable shoe means transversely of said apparatus between a first position transversely inwardly in said apparatus from said stationary folding shoe means and slightly below said inside edge of said stationary folding shoe means and a second position extending under said inside edge of said stationary folding shoe means for cooperating therewith to fold the extending edge portion of the article about and under said inside edge of said stationary folding shoe means to form the second fold in the article; and sewing means carried by said frame means and positioned in said apparatus following said folding means in the successive path of travel of the articles through said apparatus for receiving and stitching the folded hem along the one edge portion of each successive article as the articles fed by said feeding means from said folding means through said apparatus.

4. Apparatus, as set forth in claim 1, 2 or 3, in which said movable folding shoe means further includes means for reciprocating said movable shoe means, while positioned in its first transverse inward position, between an upper position above said platform means to allow said platform means to move between its first and second positions without interference and a lower position slightly below said inside edge of said folding shoe means to engage the top of the folded-over portion of the edge of the article which extends over said inside edge of said stationary folding shoe for reciprocation of said movable folding shoe means to its second transverse position under said inside edge of said stationary folding shoe to form the second fold in the article.

5. Apparatus, as set forth in claim 4 in which said means for reciprocating said movable platform means and said movable shoe means between their various positions comprise fluid-operated piston and cylinder mechanisms.

6. Apparatus, as set forth in claim 2 or 3, in which said feeding means comprises a first set of at least one driven conveyor belt means extending longitudinally of said apparatus and positioned for successively receiving on the top thereof the portion of each of the articles which is not to be folded, and means cooperating with said first set of conveyor belt means for holding each of the articles against said first set of conveyor belt means during travel of the articles through said apparatus and for releasing such engagement when each article reaches said folding means for allowing such article to stop in a folding position, a second set of at least one driven conveyor belt means extending longitudinally of said apparatus over at least said folding means and being pivotally mounted at one end thereof downstream of said folding means in the path of travel of the articles through said apparatus for movement between a first position above and out of engagement with the article in the folding position to allow folding thereof while the article is stopped and a second position in engagement with the top of the folded-over portion of the article on top of said stationary folding shoe for feeding the article out of said folding means and through the remainder of said apparatus after folding thereof, and a third set of at least one driven conveyor belt means extending longitudinally of said apparatus below at least said folding means and being pivotally mounted downstream of said folding means in the path of travel of the articles through said apparatus for movement between a first position below and out of engagement with the article in the folding position to allow folding thereof while the article is stopped and a second position in engagement with the bottom of the article on the bottom of said stationary folding shoe for feeding the article out of the folding means after folding and through the remainder of the apparatus.

7. Apparatus, as set forth in claim 6 in which said means for holding each of the articles against said first set of conveyor belt means comprises air manifold means for selectively applying streams of air against the articles.

* * * * *